US011854755B2

(12) United States Patent
Koprivsek et al.

(10) Patent No.: US 11,854,755 B2
(45) Date of Patent: Dec. 26, 2023

(54) DIRECT CURRENT ELECTRIC CIRCUIT INTERRUPTING SWITCH ASSEMBLY

(71) Applicant: ETI Elektroelement, d.o.o., Izlake (SI)

(72) Inventors: Mitja Koprivsek, Izlake (SI); Brane Lebar, Zagorje ob Savi (SI)

(73) Assignee: ETI ELEKTROELEMENT, D.O.O.

( * ) Notice: Subject to any disclaimer, the term of this patent is extended or adjusted under 35 U.S.C. 154(b) by 218 days.

(21) Appl. No.: 17/606,382

(22) PCT Filed: Mar. 26, 2020

(86) PCT No.: PCT/SI2020/000004
§ 371 (c)(1),
(2) Date: Oct. 25, 2021

(87) PCT Pub. No.: WO2020/218977
PCT Pub. Date: Oct. 29, 2020

(65) Prior Publication Data

US 2023/0223226 A1 Jul. 13, 2023

(30) Foreign Application Priority Data

Apr. 25, 2019 (SI) ..... 201900088

(51) Int. Cl.
*H01H 39/00* (2006.01)
*H01H 37/76* (2006.01)
(Continued)

(52) U.S. Cl.
CPC ..... *H01H 37/76* (2013.01); *H01H 39/006* (2013.01); *H01H 71/2445* (2013.01); *H01H 85/0241* (2013.01)

(58) Field of Classification Search
CPC .. H01H 37/76; H01H 39/006; H01H 85/0241; H01H 9/54; H01H 2039/008
See application file for complete search history.

(56) References Cited

U.S. PATENT DOCUMENTS 5,847,632 A 12/1998 Oshima
9,221,343 B2 12/2015 Tokarz et al.
(Continued)

FOREIGN PATENT DOCUMENTS

DE 102015225521 A1 6/2017
WO WO 2017/042321 A1 3/2017
WO WO2019/027374 A1 2/2019

OTHER PUBLICATIONS

International Search Report and Written Opinion dated Jun. 24, 2020 issued in co-pending PCT App. No. PCT/SI2020/000004 (12 pages).

(Continued)

*Primary Examiner* — Sibin Chen
(74) *Attorney, Agent, or Firm* — Haynes and Boone, LLP; William B. Nash; Jason Whitney

(57) ABSTRACT

A direct current electric circuit interrupting switch assembly is disclosed that comprises a pyroswitch assembly, which comprises at least two pyroswitches, which are connected in parallel with each other and are each per se integrated in its respective electrically conductive branch together forming a second branch of the primary electric conductor the switch assembly, with a first, preceding pyroswitch and a second, subsequent, or last pyroswitch. Each of said pyroswitches comprises an interrupting member, by means of which each circuit with each of the pyroswitches is either connected during normal operation or is interrupted by displacing each corresponding interrupting member into another position, when a pre-determined condition is met.

5 Claims, 4 Drawing Sheets

(51) Int. Cl.
*H01H 71/24* (2006.01)
*H01H 85/02* (2006.01)

(56) References Cited

U.S. PATENT DOCUMENTS

| | | | | |
|---|---|---|---|---|
| 11,069,498 | B2 | 7/2021 | Koprivsek et al. | |
| 2016/0336131 | A1* | 11/2016 | Fellmer | H01H 33/182 |
| 2018/0281602 | A1* | 10/2018 | Strasser | B60L 3/0007 |
| 2018/0342862 | A1* | 11/2018 | Zacher | H02H 3/085 |
| 2021/0166902 | A1* | 6/2021 | Koprivsek | H01H 9/10 |

OTHER PUBLICATIONS

International Preliminary Report on Patentability dated Mar. 4, 2021 issued in co-pending PCT App. No. PCT/SI2020/000004 (38 pages).

* cited by examiner

DIRECT CURRENT ELECTRIC CIRCUIT INTERRUPTING SWITCH ASSEMBLY

CROSS-REFERENCE TO RELATED APPLICATIONS

This application is a United States national phase application of co-pending International Patent Application No. PCT/SI2020/000004 filed on 26 Mar. 2020, which claims the benefit of Slovenia Patent Application No. P-201900088 filed 25 Apr. 2019, both of which are hereby incorporated by reference in their entirety.

BACKGROUND

The present disclosure refers to a direct current electric circuit interrupting switch assembly, wherein according to the International Patent Classification such inventions belong to electricity and are among basic electric components, namely switches and switch assemblies listed among switching devices, which are activated by means of explosion, which is initiated by means of appropriate apparatus in dependency of electric current, and wherein such inventions belong to the class H 01 H 39/006.

The present disclosure is based on a problem, how to create a small and simple switch assembly, which should on one hand be capable to withstand long-term repeating induction-related influences as well as dynamic current loads i.e. variations of the electric current value within each direct voltage (DC) electric circuit, and which should on the other hand by activation thereof enable promptly interrupting said electric circuit without any formation of an electric arc even when substantially higher nominal current values are present than those in previously known switch assemblies, namely when the current value is at least 400 A, in order to ensure complete electric isolation of each electric load or group of electric loads from one or more direct voltage electric sources after said interruption.

Said interruption of the electric current should be executed regardless of each disposable value of the electric current and voltage, wherein the switch assembly should be furnished with its own actuator, which should reliably react both to electrical and mechanical overloads, for example, in a motor vehicle crash situation, and should therefore be conceived as a completely autonomous assembly suitable for mounting and functioning independently to any other assemblies, which may serve for various purposes and are available in a vehicle or any other apparatus in which said switch assembly is to be mounted.

An embodiment of a direct current interrupting switch assembly may include an electric connection via a primary electric conductor and a secondary electric conductor suitable for integration between a direct voltage electric source and at least one electric load, so that by means of said conductors of the switch assembly the primary terminal of said electric source is electrically connectable with a primary terminal of each electric load, and a secondary terminal of said electric source is electrically connectable with a secondary terminal of each electric load. The primary electric conductor of said switch assembly comprises two branches, which are in parallel connected with each other, of which the first branch includes an electric fuse with a melting member, and the second branch includes a pyroswitch. Said pyroswitch is capable of interrupting said branch of the primary electric conductor extending through said pyroswitch, as well as an actuator, which is capable of activating said pyroswitch assembly due to the interruption of said second branch of the primary electric conductor by means of explosion of at least one chemical reactant contained therein by means of an electric impulse, which is received from said external sensor, which is suitable for monitoring electric current within a certain circuit, or from any other sensor, which is suitable for monitoring at least one further physical characteristic and which is available in each desired location in the area of apparatus, in which said switch assembly is integrated. Said pyroswitch comprises an interrupting member, which is in the pyroswitch moveable from its first i.e. uninterrupted position, in which it enables the second branch of the primary electric conductor to be connected and in which the interrupting member is kept apart at a sufficient distance from the secondary electric conductor, into another i.e. interrupted position, in which the circuit through the second branch of the primary electric conductor of the pyroswitch assembly is interrupted and the interrupting member is placed into a direct electrically conductive contact with the secondary conductor of the switch assembly.

However, in the discussed switch assembly said actuator in critical circumstances, for example in the case of mechanical overload, such as a motor vehicle crash situation, receives a required impulse or signal either from a sensor, which is serving for monitoring values of the electric current in each electric circuit, or from any other sensor, which is serving for monitoring any other physical value and is available in a desired location within in a vehicle or any apparatus in which said switch assembly is mounted. In such case, the functioning of the switch assembly depends on the functioning of the other device, from which said actuator should receive a signal required for triggering and displacement of the interrupting member. In a practical application this would mean that the actuator of such a switch assembly must be adapted to each particular vehicle or apparatus or sensor from which the triggering signal should be received, so that the reliability of such a switch assembly may depend on reliability of another other device from which the actuator should receive a signal required for triggering thereof.

Other embodiments or variations of a direct current electric circuit interrupting switch assembly are disclosed in Slovenia Patent SI 25500 A, Slovenia Patent SI 25501, and also in WO 2019/027374 A1. A potential embodiment of a switch assembly may allow for interruption of a direct current electric circuit and may be part of an electric connection via a primary electric conductor and secondary electric conductor suitable for integration between a direct voltage electric source and at least one load, so that by means of said conductors of the switch assembly a primary terminal of said electric source is electrically connectable with a primary terminal of each electric load, and a secondary terminal of said electric source is electrically connectable with a secondary terminal of each electric load. The primary electric conductor of the switch assembly comprises two branches, which are in parallel connected with each other, and the first branch includes an electric fuse in the form of a melt insert fuse with a melting member and the second branch includes a pyroswitch. Said pyroswitch comprises an interrupting member, which is capable to interrupt said second branch of the primary electric conductor extending through said pyroswitch, as well as an actuator, which is capable to move said interrupting member due to interruption of said second branch of the primary electric conductor by means of explosion of at least one chemical reactant contained therein by means of an electric impulse. Said pyroswitch comprises such interrupting member, which is within said pyroswitch displaceable from a first i.e. original position, in which by means of it said second branch of the primary electric conductor is uninterrupted and in which said interrupting member is held at a sufficient distance apart from the secondary electric conductor, into a second i.e. shifted position, in which the electric circuit throughout the second branch of the primary electric conductor is interrupted and the interrupting member is held in electric conductive contact with a secondary conductor of the switch assembly. Said actuator is, via said interrupting member, connectable with the secondary conductor of the switch assembly and may comprise an electric initiating member suitable for initiation of explosive chemical reaction of at least one chemical reactant contained therein by means of an electrical impulse, an actuating member, which is during said chemical reaction of said reactant upon activation of said initiating member displaceable in a direction towards the interrupting member in order to assure displacement of said interrupting member from its initial position in contact with the primary conductor and apart from the secondary conductor into its secondary position in contact with the secondary conductor, as well as an electric circuit, which is in addition to said parallel branches integrated in said primary electric conductor in such a manner that it is connected with said electric voltage source and said load in serial with said branches of the primary conductor, wherein said electric circuit consists of at least one irreversible thermal electric fuse with a contact member, which is during the regular operation of the switch assembly interrupted and is closed i.e. set into uninterrupted state only when an electric overload occurs, as well as of at least one electromagnetic reed switch with an interrupting member, which is during regular operation of the switch assembly interrupted and is closed i.e. set into uninterrupted state only when a pre-determined value of the electric current and consequently electromagnetic field within the switch assembly is exceeded. Said fuse of the actuator and said electromagnetic switch of the actuator are connected parallel with each other.

In an alternative embodiment, said actuator comprises more than one fuse, the fuses may be connected parallel with each other. Similarly in an alternative embodiment said actuator may comprise more than one electromagnetic switch, said switches may be connected parallel with each other.

One or more additional conductor(s) can be connected to said electric circuit, by means of which said circuit is then connected with at least one external sensor, so that in critical situation, for example a vehicle crash situation, said actuator may be via said additional conductor provided with a signal, which is required for initiation of displacement of the interrupting member and which is received from said external sensor, which is suitable for monitoring electric current within certain circuit, or from any other sensor, which is suitable for monitoring of at least one further physical value and which is available in a desired location of a vehicle or apparatus in which said switch assembly is installed.

Said interrupting member may be mechanically interruptible from an initial position to a second position that displaces a section of the second branch of the primary electric conductor.

Additionally, said interrupting member in its second i.e. shifted position, in which the electric circuit through the second branch of the primary electric conductor is interrupted may be held in electric conductive contact with the second electric conductor of the switch assembly, and consequently also in electric contact with each load and also with the secondary terminal of the direct voltage electric source.

The electric initiating member may be connected both with said electric circuit and with at least one additional electric conductor, which is suitable for establishing interconnection with at least one external sensor.

In a similar manner to other before known switch assemblies said known switch assembly is reliable and can when needed effectively interrupt an electric circuit, in which the nominal value of direct electric current does not exceed roughly 400 A, while at higher values of electric current its functioning is unpredictable and unreliable.

A further protective device for an electrical circuit is disclosed in WO 2017/042321 A.

A still further direct current electric circuit interrupting switch assembly is disclosed in U.S. Pat. No. 9,221,343 B2 (Tesla Motors, Inc.). Such switch assembly includes a direct electric voltage source, which is via primary and secondary conductor electrically connected with each load. Such assembly is generally suitable for mounting into electric vehicles and serves for interruption of electric circuit in emergency situations, e.g. by vehicle crash. In the disclosed device said electric voltage source is a battery or a set of mutually interconnected batteries, while said load is an inverter, via which each further electric circuits are supplied by electricity, which serve e.g. for driving vehicles, lighting, heating and air-conditioning, driving of servomotors, or the like.

In the present disclosure, the secondary electric conductor continuously extends between the negative terminal of the electric energy source and corresponding connecting terminal of the load. The primary electric conductor, which extends between the positive terminal of said direct voltage electric source and the residual connecting terminal of the load is bifurcated and consists of two separate branches, which are in parallel connected with each other, wherein in the first branch an electric fuse with a melting member is integrated, while the second branch includes a pyroswitch, which is during regular operation of the electric circuit uninterrupted. Said pyroswitch is furnished with a casing, through which extends an electric conductor, which in this particular case corresponds to said second branch of the primary conductor. In the interior of said casing a blade in form of guillotine is integrated, which consists of an electrically insulating material and which is during regular operation of the electric circuit maintained at certain distance apart from said conductor, however, it is in principle by means of a pyrotechnic actuator also movable towards the conductor, when required. Activation of said actuator occurs on the basis of a signal, which is received by actuator either from a sensor, which is suitable for monitoring values of electric current within the electric circuit, or optionally from the site of any other disposable sensors, e.g. from the sensor which serves for activation of inflatable airbags within each vehicle. By activation of such switch, both sections of such interrupted electric conductor are deflected apart from each other and remain in such state split apart from each other and also from any other electrically conductive component.

A pyroswitch is generally commercially available in two embodiments, namely in normally interrupted (NO—normally open) and normally uninterrupted (NC—normally closed). In the present disclosure such switch is during regular operation uninterrupted, but can be interrupted in any need, by which the electric circuit is interrupted. Normally closed switches are much more bulky and are therefore unsuitable for use in electric powered vehicles.

In addition to low electricity power requirements such pyroswitch also excels in extremely short reaction time by activation i.e. interruption of each electric circuit, which may be performed within approximately 1 ms. On the other hand, such switches are problematic in view of potential variations of properties of chemical reactants contained therein during the time and due to temperature variations, and in addition to that, also in view of voltage overloads and induction-related phenomena. Consequently, during each regular operation of the switch assembly both conductors are connected on the one hand with the electric voltage source, and on the other hand with each electric load, by which the electric current due to relatively high resistance of the melting member within the electric fuse the electric current is merely conducted through those branch, in which said pyroswitch is integrated. In such manner, in particular by using such switch assemblies in electric vehicles, deficiencies related to electric fuses with melting members, which are unable to withstand durable dynamic current overloads, are minimized. Namely, during exploitation of electric fuses in electric vehicles has been found that physical properties of the material of the melting member may due to long-term varying the values of current conducted there-through may be changed in such extent that any further reactions of the melting member during the forthcoming current loadings becomes relatively unpredictable and unreliable.

When a switch assembly according to U.S. Pat. No. 9,221,343 B2 is exposed to such current overloading of the electric circuit in which it is integrated, it should react by interrupting the primary electric current on the basis of a received signal, by which first of all said pyroswitch is activated, which results in interruption of current within the corresponding branch, upon which the current may still be conducted through the other branch i.e. through the melting member of the electric fuse, which then starts to melt, by which the electric circuit throughout the switch assembly i.e. between the electric voltage source and each electric load becomes completely interrupted. In case of essential current overloads, in which the current exceeds a multiple value of a nominal current limit value in the electric fuse, interruption of the melting member is performed relatively quickly, which in practice means within approximately 20 ms. However, when using such switch assembly in vehicles, the current overloads, particularly during a smooth drive, are usually not so high. In such case, during a vehicle crash said actuator should normally trigger the pyroswitch, by which the belonging branch of the primary conductor in the electric circuit is interrupted, upon which the current is re-directed through the residual branch of said conductor. When the current overload is just slightly above the nominal value of the electric fuse, then melting of said melting member may take several minutes or even more than one hour, which is in any crash situation quite unacceptable and dangerous due to the risk of establishing short circuits and/or electric arcing. In addition, even in the case of quick and successful interruption of the primary conductor in the electric circuit between the direct voltage electric circuit and each electric load, the secondary conductor still remains uninterrupted and connected with both with electric voltage source and the electric load. In particular in vehicles this deficiency may lead to problems, since said electric load is in the one hand connected with said electric voltage source, and on the other hand also with various electric circuits, where some of these may also contain capacitors, in which electric capacity still remains stored and which may represent additional electric voltage sources, which persist active despite to interruption of the primary electric conductor of such switch assembly. Such "hidden" electric voltage sources may also be extremely dangerous in said vehicle crash situations.

Other electromagnetic switches previously described in the art and known to persons skilled in the art are for example disclosed in U.S. Pat. No. 5,847,632 A. Such switches function on the basis of variations of electromagnetic field due to displacement of a magnet exposed to accelerations, which is correlated to changing of mechanical loads and/or deformations.

The present disclosure refers to a direct current electric circuit interrupting switch assembly, which is by establishing an electric connection via a primary electric conductor and a secondary electric conductor suitable for integration between a direct voltage electric source and at least one electric load, so that by means of said conductors of the switch assembly the primary terminal of said electric source is electrically connectable with a primary terminal of each electric load, and a secondary terminal of said electric source is electrically connectable with a secondary terminal of each electric load. The primary electric conductor of said switch assembly comprises two branches, which are in parallel connected with each other, of which the first branch includes an electric fuse with a melting member, and the second branch includes a pyroswitch, which is capable of interrupting said branch of the primary electric conductor extending through said pyroswitch, as well as an actuator, which is capable of activating said pyroswitch assembly due to the interruption of said second branch of the primary electric conductor by means of explosion of at least one chemical reactant contained therein by means of an electric impulse.

In the present disclosure, said pyroswitch assembly may comprise at least two pyroswitches, which are connected in parallel with each other and are each per se integrated in its respective electrically conductive branch together forming said second branch of the primary electric conductor, namely a first i.e. substantially preceding pyroswitch and a second i.e. substantially subsequent pyroswitch, wherein each of said pyroswitches comprises an interrupting member, by means of which each branch of each of the pyroswitches is either connected during normal operation or is interrupted by displacing each corresponding interrupting member into another position, when each pre-determined condition is met. Said actuator is via a sequence of at least two interrupting members of pyroswitches of the pyroswitch assembly electrically connectable with the secondary conductor of the switch assembly and may comprise an electric circuit, which is in addition to said parallel branches integrated in said primary electric conductor in such a manner, that it is connected with said electric voltage source and said electric load in serial with said branches of the primary conductor, wherein said electric circuit consists of at least one irreversible thermal electric fuse with a contact member, which is during the regular operation of the switch assembly interrupted and is closed i.e. set into uninterrupted state only when an electric overload occurs, as well as of at least one electromagnetic reed switch with an interrupting member, which is during regular operation of the switch assembly interrupted and is closed i.e. set into uninterrupted state only when a pre-determined value of the electric current within the switch assembly is exceeded, wherein said fuse of the actuator and said electromagnetic switch of the actuator are connected in parallel with each other, and wherein in the case, when said actuator comprises more than one fuse, the fuses are connected parallel with each other, and wherein in the case, when said actuator comprises more than one electromagnetic switch, all available switches are also connected parallel with each other, as well as an electric initiating member in each of the disposable pyroswitches of the pyroswitch assembly, wherein said initiating member is suitable for initiating an explosive chemical reaction of at least one chemical reactant contained therein by means of an electric impulse, an actuating member, which is available in each of the disposable pyroswitches of the pyroswitch assembly, which is during said chemical reaction of the reactant after the activation of said initiating member moveable in the direction towards the interrupting member for ensuring the movement of the interrupting member from its first position in contact with the primary conductor and apart from the secondary conductor into its other position, in which it is in indirect or direct contact with the secondary conductor.

The interrupting member of each previously-described pyroswitch, the initiating member of which is electrically connected with the circuit of said actuator, is by means of the actuating member moveable from its uninterrupted position when predetermined conditions are met to another position, in which the corresponding branch through the said pyroswitch is interrupted and the interrupting member is after the movement in an electrically conductive contact with the initiating member of each subsequent pyroswitch member, while in the last pyroswitch member, the interrupting member, is moveable into another position, in which the respectable branch through said final pyroswitch is interrupted, in which it is placed into a direct electrically conductive contact with the secondary conductor.

Additionally according to the present disclosure it is foreseen that at least one additional conductor is connected to said electric circuit, by means of which said circuit is then connected with at least one external sensor, so that in a critical situation, e.g. in a vehicle crash situation, said actuator may be via said additional conductor provided with a signal, which is required for initiating the displacement of each interrupting member and which is received from said external sensor, which is suitable for monitoring electric current within a certain circuit, or from any other sensor, which is suitable for monitoring at least one further physical characteristic and which is available in a desired location of a vehicle or apparatus in which said switch assembly is installed.

Furthermore according to the present disclosure at least one of the interrupting members may be mechanically interruptible from an initial position to another position displaceable section of the corresponding, through the pyroswitch passing branch of the second branch of the primary electric conductor.

Furthermore according to the present disclosure the interrupting member of the last pyroswitch in each pyroswitch assembly in its second, that is, interrupted position, in which the electric circuit through all branches of the second branch of the primary electric conductor of the switch assembly is interrupted, is brought into an electrically conductive contact with the secondary conductor of the switch assembly and indirectly also in electric contact with any electric load, as well as with the secondary terminal of the direct voltage electric source.

Furthermore according to the present disclosure each electrical initiating member may be connected to said circuit of the actuator and may be with the initiating member of each subsequent pyroswitch in the pyroswitch assembly, wherein the initiating member of the last pyroswitch in the pyroswitch assembly is electrically connected with the secondary conductor of the electric circuit, in which the switch assembly is integrated.

BRIEF DESCRIPTION OF THE DRAWINGS

The present disclosure will now be explained in some more detail by means of an embodiment, which is schematically presented in attached figures, wherein.

DETAILED DESCRIPTION

Figure 1:
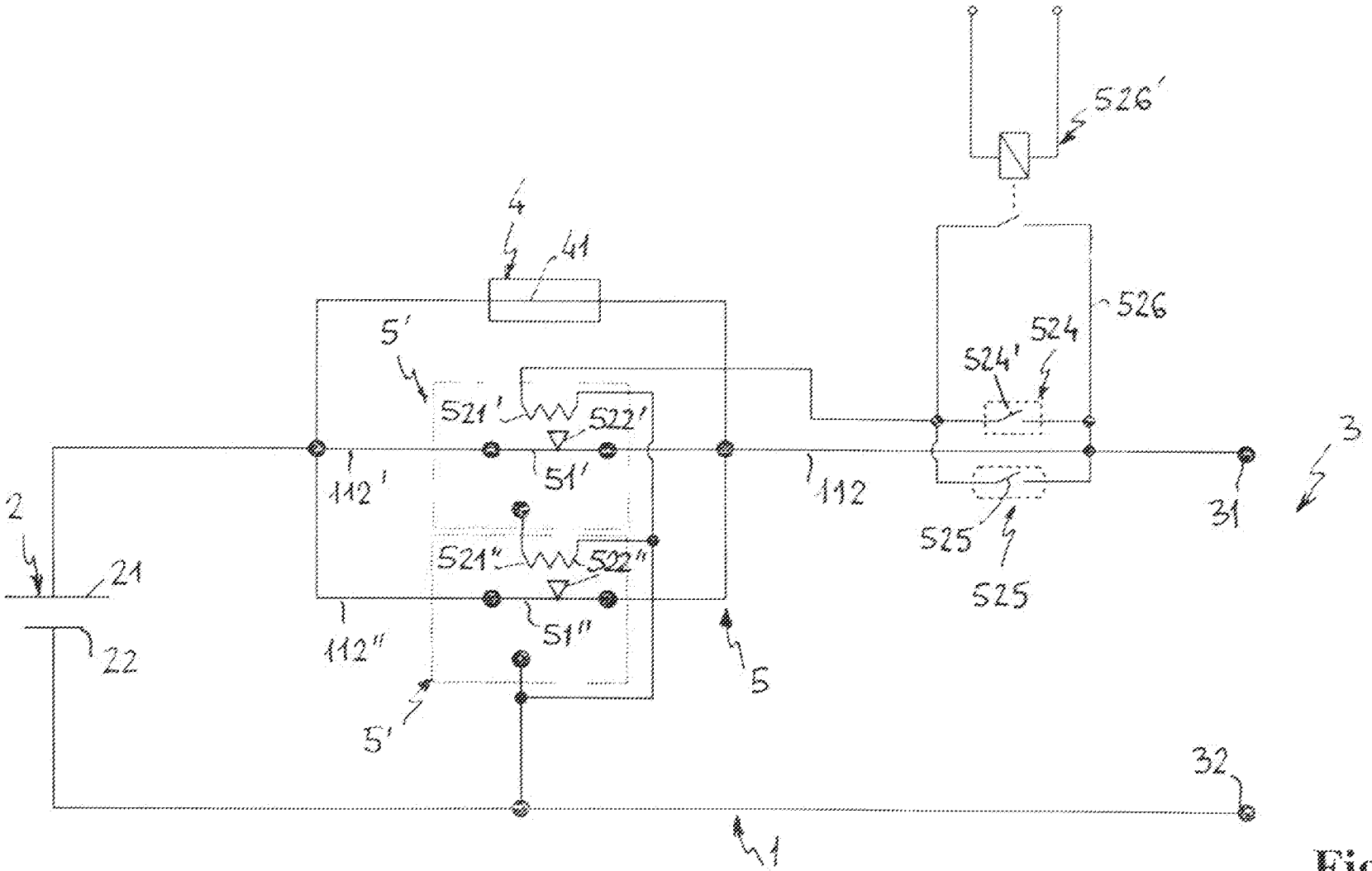
FIG. 1 presents a switch assembly together with a corresponding electric circuit during normal operation of the electric circuit.

A direct current interrupting switch assembly 1 is therefore schematically shown in FIGS. 1-4, and is by establishing an electric connection via a primary electric conductor 11 and a secondary electric conductor 12 suitable for integration between a direct voltage electric source 2 and at least one electric load 3, so that by means of said conductors 11, 12 of the switch assembly 1 the primary terminal 21 of said electric source 2 is electrically connectable with a primary terminal 31 of each electric load 3, and a secondary terminal 22 of said electric source 2 is electrically connectable with a secondary terminal 32 of each electric load 3, wherein the primary electric conductor 11 of said switch assembly 1 comprises two branches 111, 112, which are in parallel connected with each other, of which the first branch 111 includes an electric fuse 4 with a melting member 41, and the second branch 112 includes a pyroswitch 5, which is capable of interrupting said branch 112 of the primary electric conductor 11 extending through said pyroswitch 5, as well as an actuator 52, which is capable of activating said pyroswitch assembly 5 due to the interruption of said second branch 112 of the primary electric conductor 11 by means of explosion of at least one chemical reactant contained therein by means of an electric impulse.

As further evident in FIGS. 1-4, said pyroswitch assembly 5 may comprise at least two pyroswitches 5', 5", which are connected in parallel with each other and are each per se integrated in its respective electrically conductive branch 112', 112" together forming said second branch 112 of the primary electric conductor 11, namely a first i.e. substantially preceding pyroswitch 5' and a second i.e. substantially subsequent pyroswitch 5". Each of said pyroswitches 5', 5" comprises an interrupting member 51', 51", by means of which each branch 112', 112" of each of the pyroswitches 5', 5" is either connected during normal operation or is interrupted by displacing each corresponding interrupting member 51', 51" into another position, when each pre-determined condition is met. In the shown example according to FIGS. 1-4 the pyroswitch assembly 5 comprises two pyroswitches, however in general it is possible to use a pyroswitch array comprised of three or more pyroswitches 5', 5", 5''' and so on in pyroswitch assembly 5.

Said actuator 52 is via a sequence of at least two interrupting members 51', 51" of pyroswitches 5', 5" of the pyroswitch assembly 5 electrically connectable with the secondary conductor 12 of the switch assembly 1 and comprises an electric circuit 523, which is in addition to said parallel branches 111, 112 integrated in said primary electric conductor 11 in such a manner, that it is connected with said electric voltage source 2 and said electric load 3 in serial with said branches 111, 112 of the primary conductor 11. Said electric circuit 523 consists of at least one irreversible thermal electric fuse 524 with a contact member 524', which is during the regular operation of the switch assembly 1 interrupted and is closed i.e. set into uninterrupted state only when an electric overload occurs, as well as of at least one electromagnetic reed switch 525 with an interrupting member 525', which is during regular operation of the switch assembly 1 interrupted and is closed i.e. set into uninterrupted state only when a pre-determined value of the electric current within the switch assembly 1 is exceeded. Said fuse 524 of the actuator 52 and said electromagnetic switch 525 of the actuator 52 are connected in parallel with each other. In the case, when said actuator 52 comprises more than one fuse 524, the fuses 524 are connected parallel with each other. Similarly, when said actuator 52 comprises more than one electromagnetic switch 525, all available switches 525 are also connected parallel with each other.

In addition, said actuator 52 comprises an electric initiating member 521', 521" in each of the disposable pyroswitches 5', 5" of the pyroswitch assembly 5, wherein said initiating member 521', 521" is suitable for initiating an explosive chemical reaction of at least one chemical reactant contained therein by means of an electric impulse.

Furthermore, said actuator 52 comprises an actuating member 522', which is available in each of the disposable pyroswitches 5', 5" of the pyroswitch assembly 5, which is during said chemical reaction of the reactant after the activation of said initiating member 521 moveable in the direction towards the interrupting member 51 for ensuring the movement of the interrupting member 51 from its first position in contact with the primary conductor 11 and apart from the secondary conductor 12 into its other position, in which it is in indirect or direct contact with the secondary conductor 12.

The interrupting member 51' of each previous pyroswitch 5', the initiating member 521' of which is electrically connected with the circuit 523 of said actuator 52, is by means of the actuating member 522' moveable from its uninterrupted position when predetermined conditions are met to another position, in which the corresponding branch 112' through the said pyroswitch 5' is interrupted and the interrupting member 51' is after the movement in an electrically conductive contact with the initiating member 521" of each subsequent pyroswitch member 52', while in the last pyroswitch member 5", the interrupting member 51", is moveable into another position, in which the respectable branch 112" through said final pyroswitch 5" is interrupted, in which it is placed into a direct electrically conductive contact with the secondary conductor 12.

At least one additional conductor 526 is optionally connected to said electric circuit 523, by means of which said circuit 523 is then connected with at least one external sensor 526', so that in a critical situation, e.g. in a vehicle crash situation, said actuator 52 may be via said additional conductor 526 provided with a signal, which is required for initiating the displacement of each interrupting member 51', 51" and which is received from said external sensor 526', which is suitable for monitoring electric current within a certain circuit, or from any other sensor, which is suitable for monitoring at least one further physical characteristic and which is available in a desire location in the vehicle or apparatus, in which said switch assembly 1 is installed.

Furthermore, at least one of the interrupting members 51', 51" may be mechanically interruptible from its initial position to another position corresponding through the pyroswitch 5', 5" passing branch 112', 112" of the second branch 112 of the primary electric conductor 11.

Figure 3:
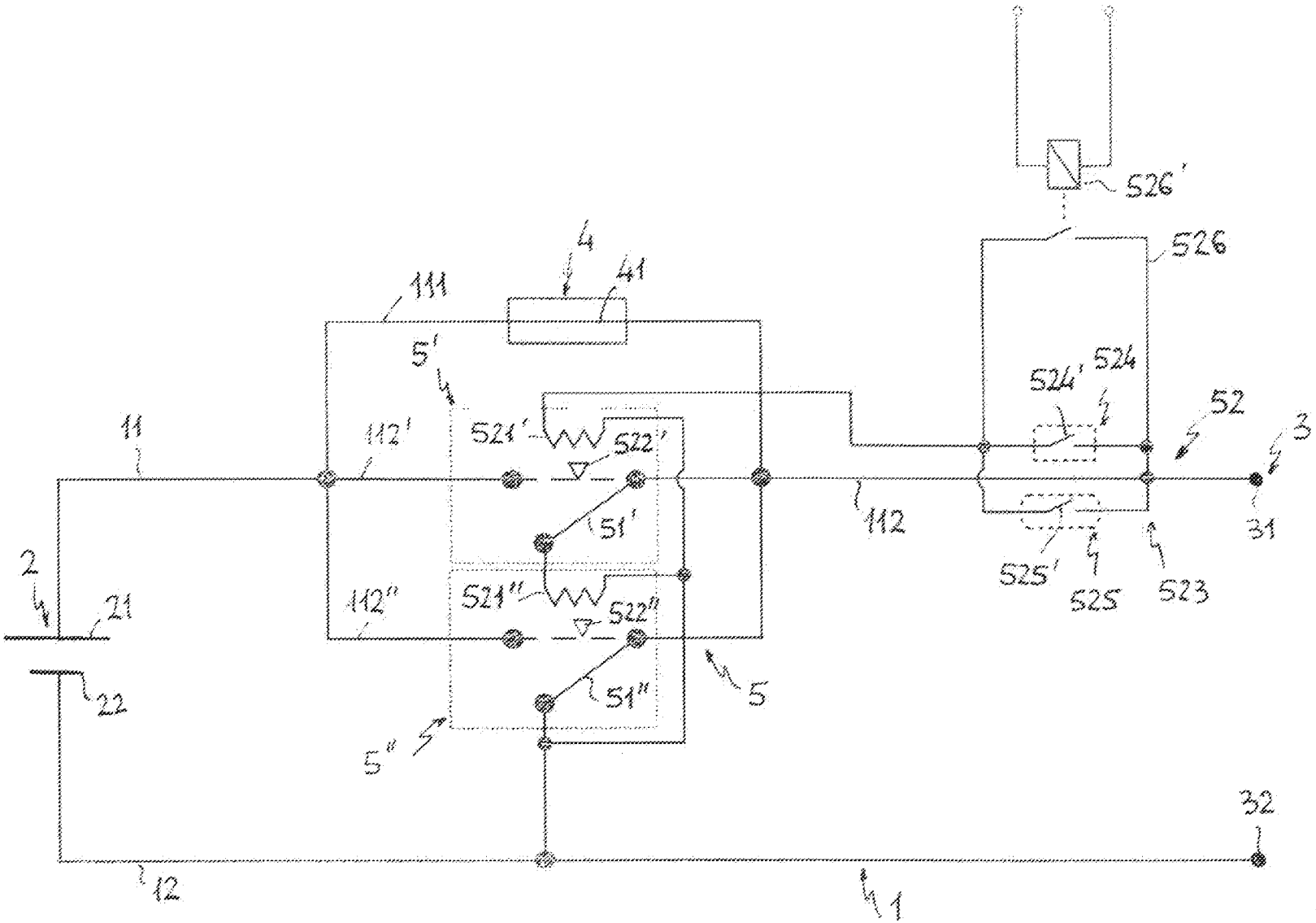
FIG. 3. presents the switch assembly according to FIG. 1 during the subsequent step of interrupting the electric circuit at the presence of an external disturbance or electric overload in the electric circuit.
Figure 4:
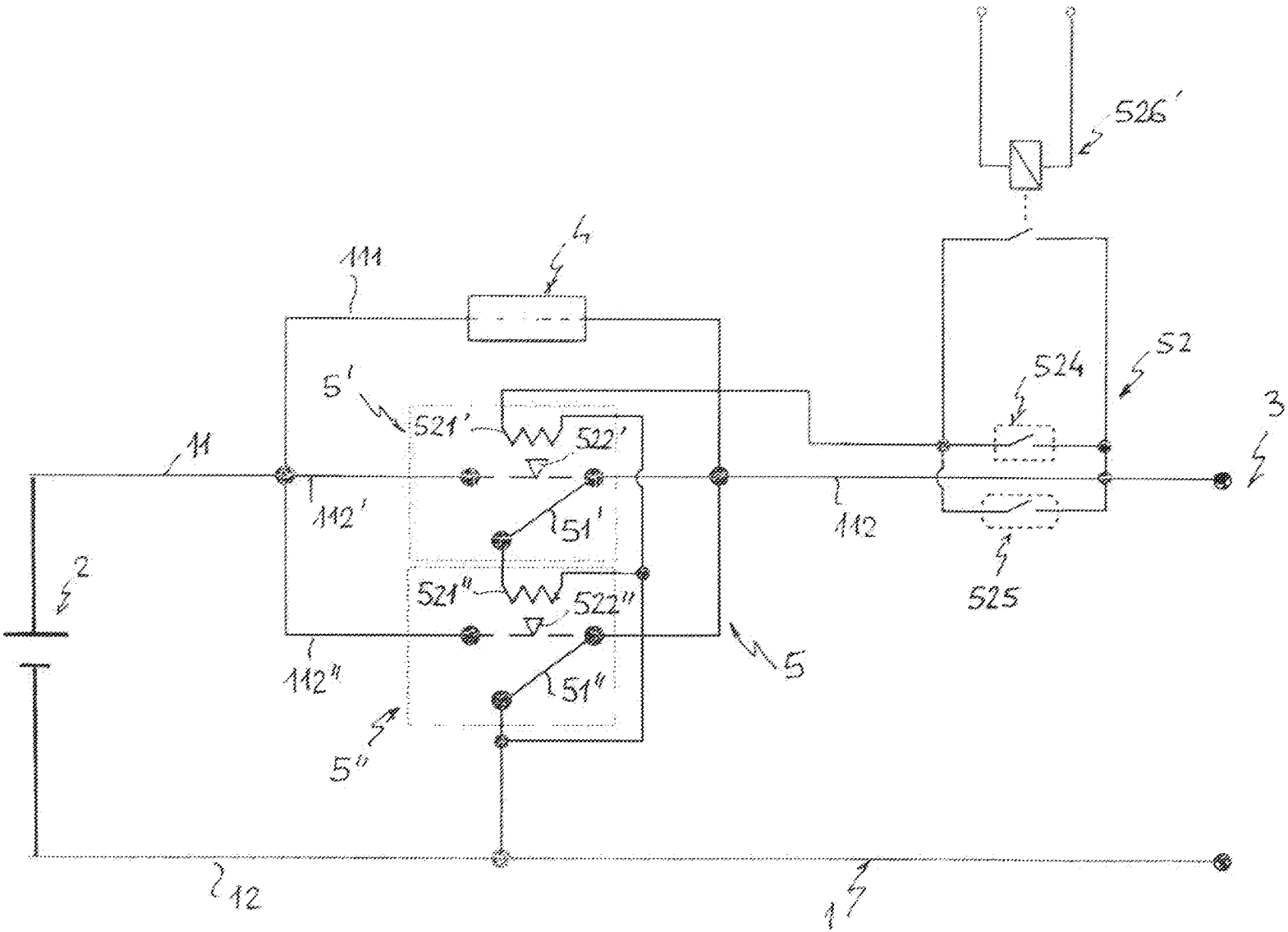
FIG. 4. Presents the switch assembly according to FIG. 1. after the electric circuit has been completely interrupted due to an external disturbance or electric overload in the electric circuit.

In the embodiment shown in the Figures, the interrupting member 51" of the last pyroswitch, in the present embodiment 5", in each pyroswitch assembly 5 in its second, that is, interrupted position, in which the electric circuit through all branches 112', 112" of the second branch 112 of the primary electric conductor 11 of the switch assembly 1 is interrupted, is brought into an electrically conductive contact with the secondary conductor 12 of the switch assembly 1 and indirectly also in electric contact with any electric load 3, as well as with the secondary terminal 22 of the direct voltage electric source 2 as shown in FIGS. 3 and 4.

Each electrical initiating member 521' is on one hand connected to said circuit 523 of the actuator 52 and on the other hand with the initiating member 521" of each subsequent pyroswitch 5', 5" in the pyroswitch assembly 5, wherein the initiating member 521" of the last pyroswitch 5" in the pyroswitch assembly 5 is electrically connected with the secondary conductor 12 of the electric circuit, in which the switch assembly 1 is integrated.

The electric resistance of the first branch 111 of the primary electric conductor 11 is much higher than the electric resistance of the second branch 112, 112', 112", which results in most of the electric current passing through the second branch 112, 112', 112" during regular operation of the electric circuit. In practice because of the electric fuse 4 with its melting member 41, the electric resistance of the first branch 111 may in some embodiments be more than 95% higher than the electric resistance of the second branch 112 with the second branch 112 being less than 5% of the total electric resistance of the primary electric conductor 111.

Figure 2:
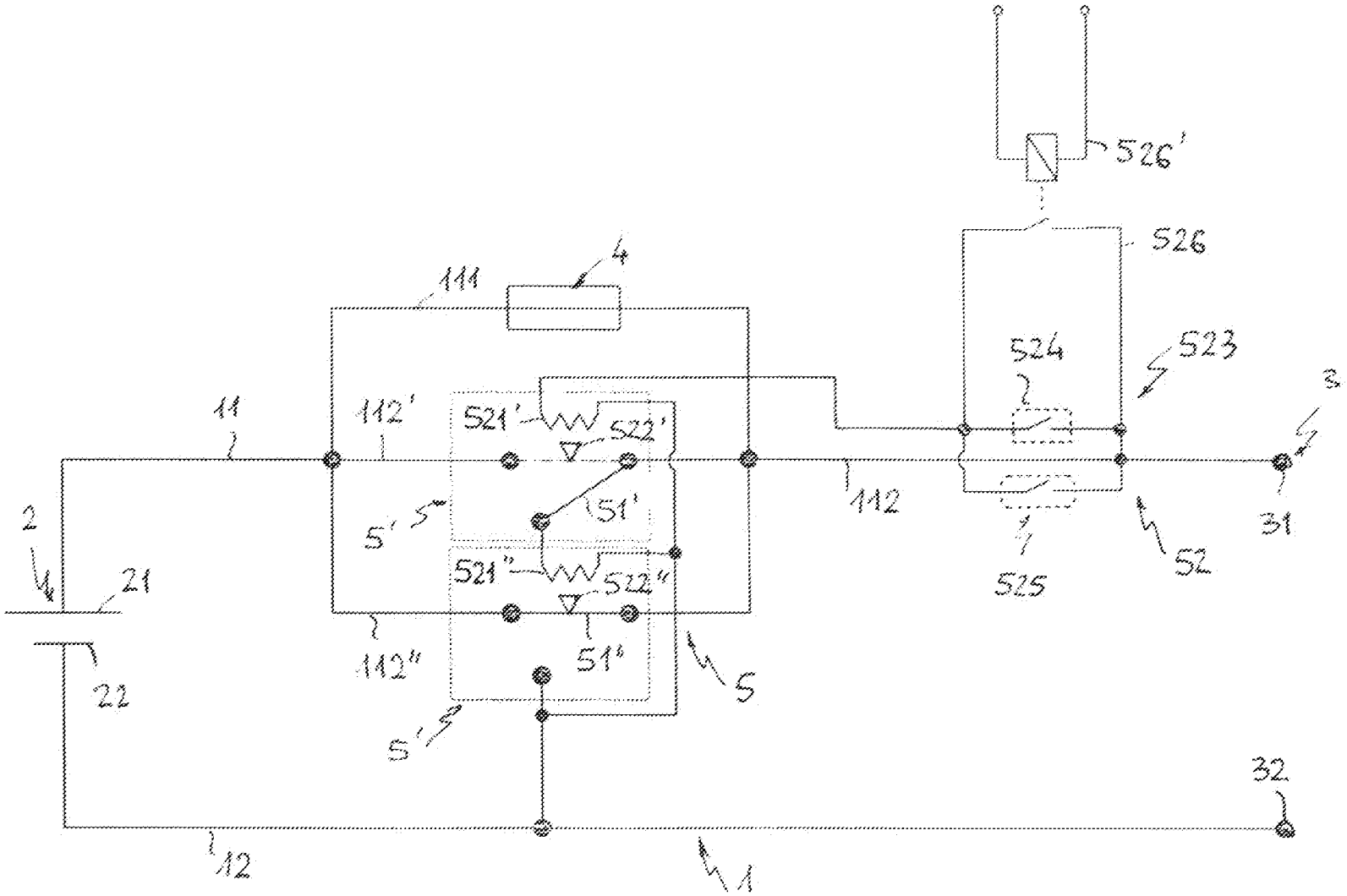
FIG. 2 presents the switch assembly according to FIG. 1 in the first step of interrupting the electric circuit at the presence of an external disturbance or electric overload in the electric circuit.

As shown in FIG. 2, when the initiating member 521' in the area of the first pyroswitch 5', when the predetermined conditions in the electric circuit 523 are met, triggers the actuating member 522' and causes the movement of the interrupting member 51' of the first pyroswitch 5' into contact with the initiating member 521" of the further pyroswitch 5", the electric circuit is redirected from the newly interrupted branch 112' through the further available branch 112" and the pyroswitch 5". In case of—again when predetermined conditions are met—the activation of the initiating member 521" of the second pyroswitch 5" in the electric circuit 523, the actuating member 522" triggers the movement of the interrupting member 51" of the second pyroswitch 5" (FIG. 2) into electric contact with the initiating member of a yet further, subsequent pyroswitch, then it is available. In the exemplary embodiment, only two pyroswitches 5', 5" are foreseen, which means that after the activation of the initiating member 521" the interrupting member 51" of the second pyroswitch 5" is moved into contact with the secondary conductor 12 of the electric circuit, in which the switch assembly 1 according to the invention is integrated. Persons of ordinary skill in the art can understand how to add additional pyroswitches to the disclosed embodiment to use three or more within switch assembly 1.

According the present disclosure the pyroswitch assembly 5 may be comprised of an array of pyroswitches 5', 5", connected into the electric circuit and arranged in the previously described manner and as shown in the accompanying Figures, the interruption of the electric circuit may be executed gradually and in series of multiple steps, depending on the number of pyroswitches 5', 5" in the pyroswitch assembly 5, which in practice enables the use of the switch assembly 1 in circuits which are exposed to high values of direct electric current including values that may exceed 400 A.

The switch assembly 1 according to the disclosure is no doubt simple and is despite to introduction of appropriate pyroswitch 5 not bulky in view of required space. Thanks to arrangement of said pyroswitch 5 and the electric fuse 4 with its melting member 41 into two separate branches 111, 112 of primary electric conductor 11 such switch assembly 1 is capable to withstand temperature variations of temperature variations and is moreover able to deal with inductivity variations of inductivity as well as dynamic current intensity, i.e. frequently changing of electric current values within each particular direct voltage (DC) electric circuit. On the other hand, said switch assembly 1 enables a prompt interruption of said direct voltage electric circuit on the basis of activation of the actuator 52, e.g. in situation of motor vehicle crash, regardless to each electric voltage and actual value of the electric current, and in particular without establishing an electric arc in the area of the pyroswitch assembly 5. Each disposable electric load(s) become(s) completely insulated with regard to each disposable direct voltage electric source 2. Thanks to said displacement of each interrupting member 51', 51" from its original i.e. uninterrupted position into its shifted position in contact with the secondary conductor 12 in each direct voltage circuit, via said switch assembly 1 and each load 3 an additional electric circuit is established, which is completely separated from the electric voltage source 2, and although any additional electric sources remain isolated within such newly established circuit, such sources cannot be brought in contact with the electric source 2.

The present disclosure may enable automatic activation of the switch assembly 1 when pre-determined requirements are met. To this aim, said actuator 52 of said pyroswitch 5 is via said interrupting member 51 connectable with the secondary conductor 12 of the switch assembly 1 and comprises in the area of each of the pyroswitches 5', 5" an electric initiating member 521', 521", in proximity to which an actuating member 522', 522" is arranged, as well as an electric circuit 523, which will be one by one explained in more detail.

Each electric initiating member 521', 521" is suitable for initiation of explosive chemical reaction in each corresponding pyroswitch 5', 5" of the pyroswitch assembly 5 of at least one chemical reactant contained therein by means of an electrical impulse, wherein the chemical structure of said chemical reactant can correspond to those, which is used in pyro-switches which are known in the prior art.

Each actuating member 522', 522" is during said chemical reaction of said reactant upon activation of each corresponding initiating member 521', 521" displaceable in a direction towards each corresponding interrupting member 51', 51" just in order to assure displacement of each interrupting member 51', 51" from its initial position in contact with the primary conductor 11 and apart from the secondary conductor 12 into its secondary position in contact with the initiating member 521" of each subsequent pyroswitch 5" and in the case of a final pyroswitch member 5" with the secondary conductor 12 itself.

Said electric circuit 523 is in addition to said parallel branches 111, 112 integrated in said primary electric conductor 11 in such a manner, that it is connected with said electric voltage source 2 and said load 3 in serial with said branches 111, 112 of the primary conductor 11. In this, said electric circuit 523 consists of at least one irreversible thermal electric fuse 524 with a contact member 524', which is during the regular operation of the switch assembly 1 interrupted and is closed i.e. set into uninterrupted state only when an electric overload occurs, as well as of at least one electromagnetic reed switch 525 with an interrupting member 525', which is during regular operation of the switch assembly 1 interrupted and is closed i.e. set into uninterrupted state only when a pre-determined value of the electric current within the switch assembly 1 is exceeded. Said fuse 524 of the actuator 52 and said electromagnetic switch 525 of the actuator 52 are connected parallel with each other.

Also in the case, when said actuator 52 comprises more than one fuse 524, each disposable fuses 524 are connected parallel with each other, and quite similarly, whenever said actuator 52 comprises more than one electromagnetic switch 525, then each disposable switches 525 are also connected parallel with each other.

The electric initiating member 521 is connected both with said electric circuit 523 and with at least one additional electric conductor 526, which is suitable for establishing interconnection with at least one external sensor 526'.

A further embodiment is also possible, in which said actuator (52) can be in critical situation, e.g. in a vehicle crash situation, provided with a signal, which is required for initiation of displacement of the interrupting member (51) and which is via said additional conductor 526 received from said external sensor 526', which is suitable for monitoring electric current values within certain circuit, or from any other sensor, which is suitable for monitoring of at least one further physical value and which is available in a desired location in a motor vehicle or other similar apparatus, in which said switch assembly 1 is installed.

Among other methods, activation of such switch assembly may be generally performed either by exceeding current overload or in a short circuit situation.

Activation by exceeding current may be performed by means of said irreversible thermal electric fuse 524, which is arranged in a heat conductive contact with conductive components of the switch assembly. By increasing the electric current, the temperature is also increasing, and each activation conditions can be defined in advance on the basis of suitable dimensioning or choice of the fuse 524. As soon as the electric current becomes higher than a pre-determined nominal value, conductive components of the pyro-switch start heating, and the fuse 524 with its contact member 524' is also heated. As soon as a pre-determined temperature is reached, the contact member 524' of the fuse 524 is shifted and the electric circuit through the fuse 524 is established i.e. uninterrupted, and the electric current starts flowing therethrough, which is however limited with resistance of the actuator 52, so that in the case of overload said pyroswitch 5 is activated, so the interrupting member 51 is by means of actuator 52 shifted from its initial position in contact with the primary conductor 11 into its secondary position in contact with the secondary conductor 12.

Activation in a short circuit situation may be performed by means of said electromagnetic reed switch 525, which is sensible to the external magnetic field and is capable to react within extremely short time period, e.g. within 50 μs. Said time period may be shorter when a higher current is present and correspondingly higher magnetic field strength. Such short activation i.e. triggering time period needs to be achieved in particular due to current withstanding of the pyroswitch in the short circuit conditions. Said electromagnetic reed switch is arranged at a distance apart from conductive components of the pyroswitch 5', 5", and each condition, in which the electromagnetic switch 525 is reacting to short circuit overload, can also be determined in advance on the basis of adjusting the position of said switch 525, since the sensitivity i.e. reactiveness of said switch 525 is reciprocally proportional to the distance from the source of electromagnetic field. When in a short circuit situation the electric current starts to increase, the electromagnetic field is generated, which impacts the electromagnetic reed switch 525. At a predetermined magnetic field strength the contact members 525' in the electromagnetic switch 525 are brought in contact with each other, and the circuit suitable for conducting electric current is herewith established within said switch 525. The current is also in this situation determined i.e. limited by resistance of the actuator 52, and by overloading i.e. by short circuit said pyroswitch 5', 5" is activated, so that by means of said actuator 52 each interrupting member 51', 51" is shifted from its initial position in contact with the primary conductor 11 into its secondary position in contact with each subsequent pyroswitch 5" and the secondary conductor 12.

What is claimed is:

1. A direct current electric circuit interrupting switch assembly comprising:

a primary electric conductor and a secondary electric conductor adapted for integration between an electric source and at least one load;

wherein by means of said conductors of the switch assembly a primary terminal of said electric source is electrically connectable with a primary terminal of each electric load, and a secondary terminal of said electric source is electrically connectable with a secondary terminal of each electric load;

wherein the primary electric conductor of the switch assembly comprises two branches, which are in parallel connected with each other, the first branch including an electric fuse with a melting member, and the second branch including a pyroswitch assembly which is capable of interrupting current flow in said second branch of the primary electric conductor extending through said pyroswitch assembly, as well as an actuator, which is capable of activating said pyroswitch assembly due to the interruption of said second branch of the primary electric conductor by means of explosion of at least one chemical reactant contained therein by means of an electric impulse;

wherein said pyroswitch assembly comprises at least two pyroswitches which are connected in parallel with each other, with the at least two pyroswitches comprising a first pyroswitch and a last pyroswitch, wherein each of the at least two pyroswitches comprises an interrupting member, by means of which each circuit path of each of the pyroswitches is either connected during normal operation or is interrupted by movement of the corresponding interrupting member into another position;

and wherein said actuator, via the least two interrupting members in the at least two pyroswitches is electrically connectable with the secondary electric conductor;

said actuator further comprising:

an actuator electric circuit which is electrically connected with said primary electric conductor such that it is connected with said electric voltage source and said electric load in series with said first and second branches of the primary conductor;

wherein said actuator electric circuit comprises at least one irreversible thermal electric fuse with a contact member, which is during normal operation of the switch assembly interrupted, and which is closed when an electric overload occurs;

wherein said actuator electric circuit comprises at least one electromagnetic reed switch, which is during normal operation of the switch assembly interrupted, and which is closed when a pre-determined value of the electric current within the switch assembly is exceeded; and wherein said thermal electric fuse and said electromagnetic reed are connected in parallel with each other;

wherein each pyroswitch comprises an electric initiating member, capable of initiating an explosive chemical reaction of at least one chemical reactant contained therein by means of an electric impulse;

wherein each pyroswitch further comprises an actuating member, which is capable of moving the interrupting member from a first position in contact with the primary conductor into another position where the circuit in the primary conductor is interrupted;

wherein the electric initiating member of the first pyroswitch is electrically connected with the actuator electric circuit and the actuating member of the first pyroswitch is capable of moving the interrupting member of the first pyroswitch from its uninterrupted position to another position, whereby the circuit through the said pyroswitch is interrupted and the interrupting member is after movement in electrically conductive contact with an electric initiating member of a subsequent pyroswitch member, whereby the interrupting member in the last pyroswitch is after movement in electrically conductive contact with the secondary conductor.

2. The switch assembly according to claim 1, further comprising at least one additional conductor connected to said actuator electric circuit wherein said circuit is then connected with at least one external sensor, so that said actuator may be, via said additional conductor, provided with a signal, which is required for initiating the electric initiating member of each pyroswitch and which is received from said external sensor, which is adapted for monitoring electric current within an external circuit or at least one further physical characteristic external to the switch assembly.

3. The switch assembly according to claim 1, wherein at least one of the interrupting members is capable of being mechanically actuated from an initial position to a second position within the second branch of the primary electric conductor.

4. The switch assembly according to claim 1, wherein the interrupting member of the last pyroswitch of the pyroswitch assembly in its second, that is, interrupted position, is brought into an electrically conductive contact with the secondary conductor.

5. The switch assembly according to claim 1, wherein each electrical initiating member for each pyroswitch is electrically connected to said actuator electric circuit and is capable of electrically connecting to the initiating member of the subsequent pyroswitch in the pyroswitch assembly, wherein the initiating member of the last pyroswitch in the pyroswitch assembly is capable of electrically connecting with the secondary conductor in the switch assembly.

* * * * *